US010187720B1

(12) United States Patent
Kim et al.

(10) Patent No.: US 10,187,720 B1
(45) **Date of Patent: *Jan. 22, 2019**

(54) ADJUSTABLE ACOUSTIC BASS EARBUD

(71) Applicant: Google LLC, Mountain View, CA (US)

(72) Inventors: Eliot Kim, Los Gatos, CA (US); Jianchun Dong, Palo Alto, CA (US); Michael Kai Morishita, Belmont, CA (US)

(73) Assignee: Google LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/496,520

(22) Filed: Apr. 25, 2017

Related U.S. Application Data

(63) Continuation of application No. 14/030,085, filed on Sep. 18, 2013, now Pat. No. 9,668,042.

(51) Int. Cl.
*H04R 1/28* (2006.01)
*H04R 1/10* (2006.01)

(52) U.S. Cl.
CPC ..... *H04R 1/2823* (2013.01); *H04R 1/1016* (2013.01); *H04R 1/1033* (2013.01); *H04R 1/1041* (2013.01)

(58) Field of Classification Search
CPC ..... H04R 1/1016
USPC ..... 381/67, 371, 380, 425
See application file for complete search history.

(56) References Cited

U.S. PATENT DOCUMENTS

| | | | |
|---|---|---|---|
| 4,072,822 | A | 2/1978 | Yamada |
| 4,742,887 | A | 5/1988 | Yamagishi |
| 7,391,878 | B2 | 6/2008 | Liao |
| 8,340,310 | B2 | 12/2012 | Ambrose et al. |
| 8,422,717 | B2 | 4/2013 | Lin et al. |
| 8,942,405 | B2 | 1/2015 | Jones et al. |
| 2010/0061580 | A1 | 3/2010 | Tiscareno et al. |
| 2010/0322453 | A1 | 12/2010 | Matsuyama et al. |
| 2011/0081034 | A1 | 4/2011 | Tung et al. |

FOREIGN PATENT DOCUMENTS

| | | | |
|---|---|---|---|
| CN | 201550258 | U | 8/2010 |
| CN | 201690580 | U | 12/2010 |
| WO | 2009059211 | A2 | 5/2009 |

*Primary Examiner* — Md S Elahee
(74) *Attorney, Agent, or Firm* — Lerner, David, Littenberg, Krumholz & Mentlik, LLP

(57) ABSTRACT

The present disclosure provides an earphone device with sound adjustment capability that allows a user to dynamically adjust sound acoustics resonating from the device. In one aspect, the earphone device includes a housing having an acoustic output port. The acoustic output port is adapted to receive an audio signal. In this regard, sound resonates from the acoustic output port based on the audio signal. The earphone device also includes a telescopic portion having a hollow tube portion attached to the housing. The hollow tube portion may be in communication with the acoustic output port. The telescopic portion is configured to receive a fitting member. The fitting member is configured to adjust a bass range of the outputted sound resonating from the acoustic output port by passing through the telescopic portion so as to adjust a length of the hollow tube portion.

20 Claims, 6 Drawing Sheets

500

Earbud Example Frequency Response vs Bass Tube Length

600

ADJUSTABLE ACOUSTIC BASS EARBUD

CROSS-REFERENCE TO RELATED APPLICATIONS

The present application is a continuation of U.S. patent application Ser. No. 14/030,085, filed Sep. 18, 2013, the disclosure of which is incorporated herein by reference.

BACKGROUND

Various forms of portable audio devices are capable of outputting an audio source. Earphones/earbuds are a common type of audio device and various forms of these devices are available and have been developed to offer different performance levels. For example, some earphone devices have an acoustic performance range based on set dimensions of front and back volumes (e.g., quantity of a three-dimensional space enclosed by some type of boundary). Typically, the pre-configured dimensions of these volumes can control how acoustics may be perceived by an end user using the earphone device. However, depending on the type of music being played, many users may desire different acoustic levels.

BRIEF SUMMARY

Aspects of the disclosure may be advantageous for providing an earphone device with sound adjustment capability that allows a user to dynamically adjust sound acoustics resonating from the device. In one aspect, the earphone device includes a housing having an acoustic output port. The acoustic output port is adapted to receive the audio signals. In this regard, sound resonates from the acoustic output port based on the audio signals. The earphone device also includes a telescopic portion that has a hollow tube portion attached to the housing. The telescopic portion is in communication with the acoustic output port. The telescopic portion is configured to receive a fitting member. The fitting member is configured to adjust a bass range of the sound resonating from the acoustic output port by passing through the telescopic portion.

In one example, the earphone device further includes a gasket assembly attached to the telescopic portion. The gasket assembly is configured to secure the fitting member in the hollow tube portion so as to allow the fitting member to move inwardly and outwardly through the telescopic portion. Movement of the fitting member causes an adjustment in the base range by adjusting a length of the hollow portion. For example, movement of the fitting member outwardly through the telescopic portion causes an increase in the base range of the outputted sound resonating from the acoustic output port. In contrast, movement of the fitting member inwardly through the telescopic portion causes a decrease in the base range of the outputted sound resonating from the acoustic output port.

In one example, the hollow tube portion includes internal threads that are configured to accept a threaded fitting member. The threaded fitting member is configured to cause an adjustment in the base range of the sound resonating from the acoustic output port by being threadably disposed within the telescopic portion. Movement of the threaded fitting member causes an adjustment in the base range by adjusting a length of the hollow portion. For example, when the length of the hollow tube portion decreases the adjustment is an increase in the bass range and when the length of the hollow tube portion increases the adjustment is a decrease in the bass range.

Another aspect of the present disclosure provides an apparatus. The apparatus includes a housing having an acoustic output port electrically coupled to an electronic device transmitting an audio signal. In this regard, sound resonates from the acoustic output port based on the audio signal. The apparatus also includes a sound adjustment mechanism. The sound adjustment mechanism includes a telescopic portion that has a hollow tube portion attached to the housing. The sound adjustment mechanism is configured to receive a fitting member. In response to user input, the fitting member is configured to adjust a bass range of the sound resonating from the acoustic output port by passing through the telescopic portion.

Yet another aspect of the present disclosure provides a method. The method includes receiving audio signals at an earphone device with sound adjustment capability. The earphone device includes a housing having an acoustic output port. The acoustic output port is adapted to receive the audio signals. In this regard, sound resonates from the acoustic output port based on the audio signals. The earphone device includes a sound adjustment mechanism that includes a telescopic portion having a hollow tube portion attached to the housing. The sound adjustment mechanism is configured to receive a fitting member. The fitting member is configured to cause an adjustment in a base range of the sound resonating from the acoustic output port. In response to input, a length of the hollow tube portion is adjusted by passing the fitting member through the telescopic portion. As a result, an adjustment in the bass range of the sound resonating from the acoustic output port is transmitted based on the length of the hollow tube portion.

Yet another aspect of the present disclosure provides a method. The method includes receiving audio signals at an earphone device with sound adjustment capability. The earphone device includes a housing having an acoustic output port. The acoustic output port is adapted to receive the audio signals. In this regard, sound resonates from the acoustic output port based on the audio signal. The earphone device includes a sound adjustment mechanism that includes a telescopic portion having a hollow tube portion attached to the housing. The sound adjustment mechanism is configured to receive a threaded fitting member. As such, the hollow tube portion includes internal threads configured to accept the threaded fitting member. The threaded fitting member is configured to cause an adjustment in a base range of the sound resonating from the acoustic output port. In response to input, a length of the hollow tube portion is adjusted by threadably passing the threaded fitting member through the telescopic portion. As a result, an adjustment in the base range of the sound resonating from the acoustic output port is transmitted based on the length of the hollow tube portion.

DETAILED DESCRIPTION

Aspects, features and advantages of the disclosure will be appreciated when considered with reference to the following description of embodiments and accompanying figures. The same reference numbers in different drawings may identify the same or similar elements. Furthermore, the following description is not limiting; the scope of the present technology is defined by the appended claims and equivalents. While certain processes in accordance with example embodiments are shown in the figures as occurring in a linear fashion, this is not a requirement unless expressly stated herein. Different processes may be performed in a different order or concurrently. Steps may also be added or omitted unless otherwise stated.

Figure 1:
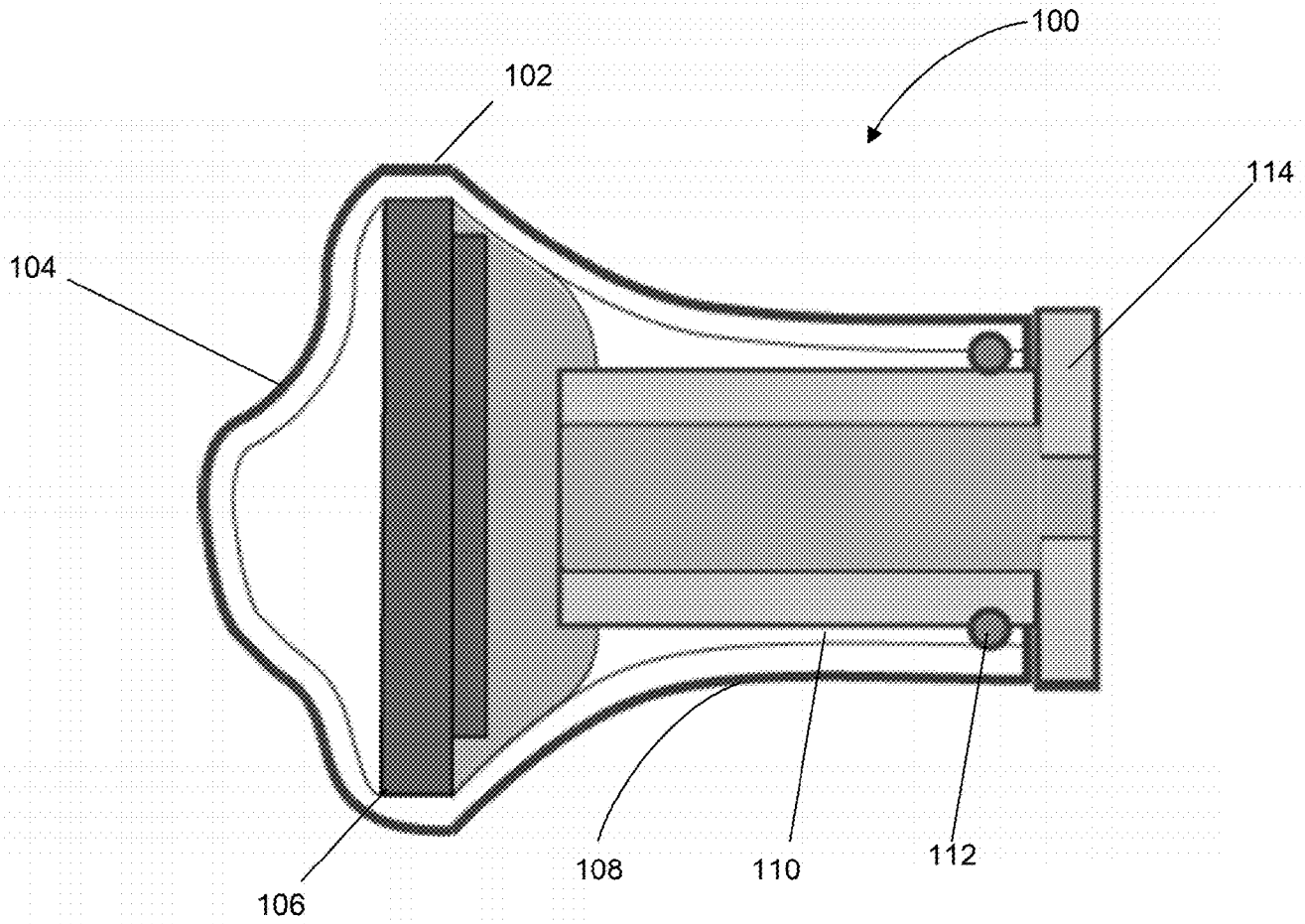
FIG. 1 is a cross sectional view of an earphone device in accordance with aspects of the present discloser.

FIG. 1 shows a cross sectional view of an earphone device 100. As shown in FIG. 1, the earphone device 100 includes a housing 102 made from a rigid material, such as a synthetic polymer or plastic, and an output port 104. The output port 104 may include an opening at a portion protruding from one end of the housing 102. In some aspects, output port 104 may be configured to receive a cap or type of cover that fits around the opening of the housing 102. The cover may be flexible enough to conform to contours of a user's ear canal entrance to provide a comfortable fit and to form at least a partial seal between the earphone device 100 and the user's ear.

Disposed within the housing 102 is a sound-generating unit 106 that may include one or more speakers and other components necessary for the unit 106 to reproduce sound. The unit's 106 sound output may emanate from the opening associated with the output port. This sound output may be based on an audio signal received, for example, from an audio source wired or wirelessly connected to the housing 102.

As shown in FIG. 1, the housing 102 includes a telescopic portion 108 that has a hollow tube portion 110 in communication with the output port 104. In some aspects, the telescopic portion 108 and the hollow tube portion 110 together may form a back chamber of the housing 102 that terminates at the output port 104.

According to aspects of the disclosure, the telescopic portion 108 may be configured to control how sound may be perceived by an end user wearing the earphone device 100. For example, depending on a length of the interior hollow tube portion 110 of the telescopic portion 108, sound may resonate at a certain frequency from the earphone device 100. As the length of the hollow tube portion 110 gradually increases (such as from 4 mm to 24 mm), performance of low-frequency characteristics (e.g., bass sound) of the earphone device 100 may improve.

To dynamically adjust the length of the hollow tube portion 110, the telescopic portion 108 may be configured with an O-ring or the like type of gasket assembly 112 capable of receiving a gasket member 114. The gasket assembly 112 may be adapted so that the gasket member 114 can be securely fit within the hollow tube portion 110. The gasket member 114 can be partially or, as shown here in FIG. 1, fully disposed within the housing 102 by passing through the telescopic portion 108. In some aspects, in response to an end user adjusting (e.g., pulling) the gasket member 114 outwardly through the telescopic portion 108, the length of the hollow tube portion 110 may increase. As the user adjusts (e.g., pushes) the gasket member 114 inwardly or otherwise back into the telescopic portion 108, the length of the hollow tube portion 110 may decrease.

In one aspect, the telescopic portion 108 may be adapted to accept a threaded gasket member (not shown), such as a type of threaded screw, which may be capable of passing through the telescopic portion 108. For example, the hollow tube portion 110 may include internal threads capable of accepting the threaded gasket member. In this regard, the threaded gasket member can be threadably disposed within the hollow tube portion 110, for example, by an end user turning the member 360 degrees (e.g., one complete rotation) in one direction or the other. As the threaded gasket member rotates in one direction, such as counter-clockwise, the threaded gasket member in response may pass outwardly from the telescopic portion 108. Based on this, the length of the hollow tube portion 110 may increase. If the threaded gasket member rotates in another direction, such as clockwise, the threaded gasket member in response may pass inwardly with respect to the telescopic portion 108. In this situation, the length of the hollow tube portion 110 may decrease.

The hollow tube portion 110 may be configured to accept and retain a threaded or non-threaded gasket member when they are fully inserted and partially inserted into the telescopic portion 108. For example, the hollow tube portion 110 may be sized and dimensioned such that the gasket member may be prevented from escaping from the hollow tube portion 110 or from passing into the hollow tube portion 110 beyond a certain threshold so as not to damage other internal components of the housing 102.

Figure 2:
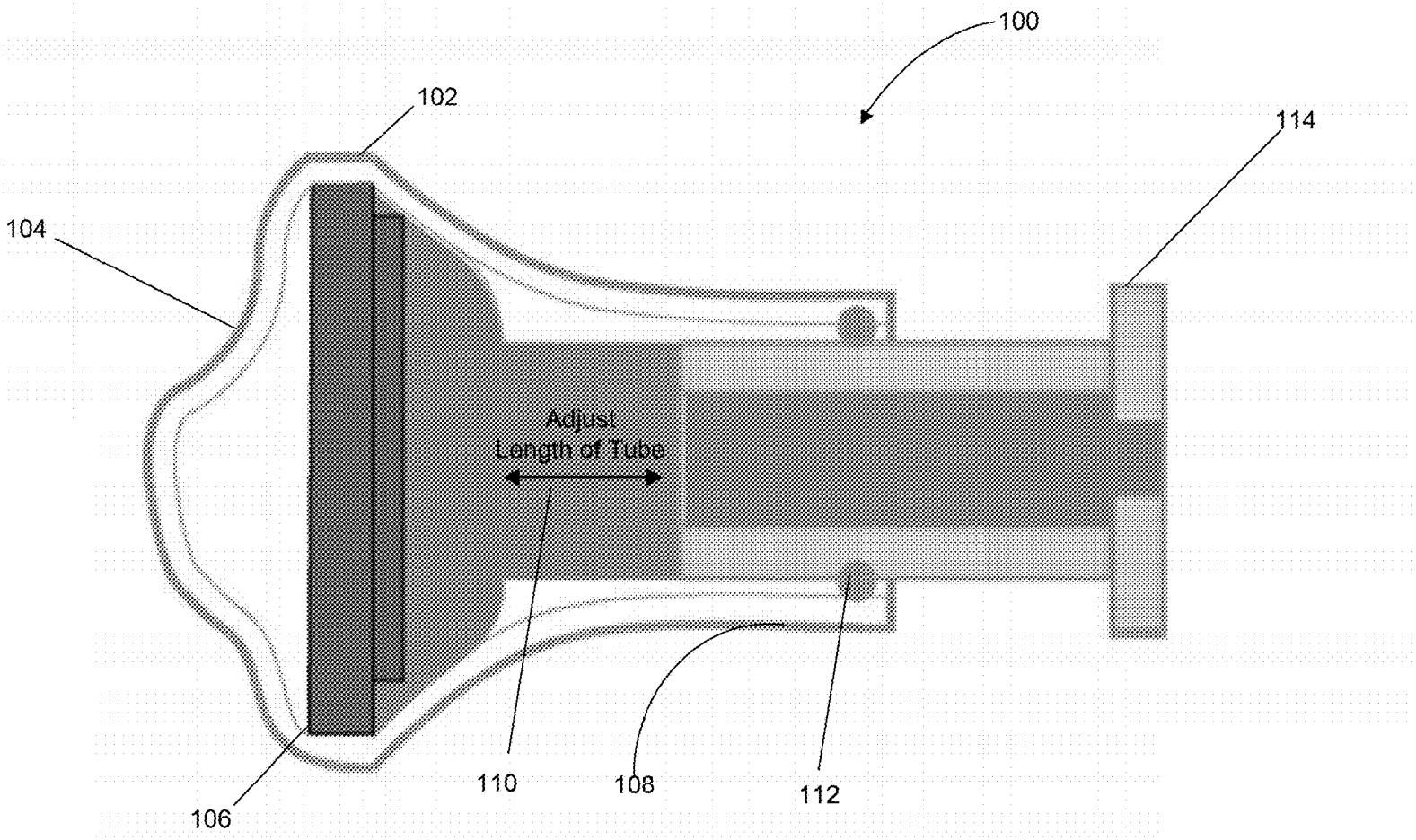
FIG. 2 is another cross sectional view of the earphone device of FIG. 1 in accordance with aspects of the present discloser.

FIG. 2 depicts another cross sectional view of the earphone device 100 of FIG. 1. As discussed above, by adjusting a length of a hollow tube portion 110 of housing 102, sound frequency resonating from output port 104 may be affected. For example, an end user may adjust the length of a hollow tube portion 110 by passing a gasket member 114 through a telescopic portion 108 of the housing 102. In FIG. 2, the gasket member 114 is shown partially disposed within the telescopic portion 108 of housing 102. Therefore, in this example, bass frequencies resonating from the earphone device 100 will be at a lower range than those resonating from the example of FIG. 1.

If the end user increases the length of a hollow tube portion 110 by further passing the gasket member 114 through the telescopic portion 108 of the housing 102 in an outwardly direction, such as away from the housing 102, bass frequencies may resonate at even lower ranges (e.g., decrease). Conversely, if the end user adjusts the gasket member 114, for example, in an inwardly direction towards the housing 102, bass frequencies may resonate from the device 100 at a higher range (e.g., increase).

Figure 3B:
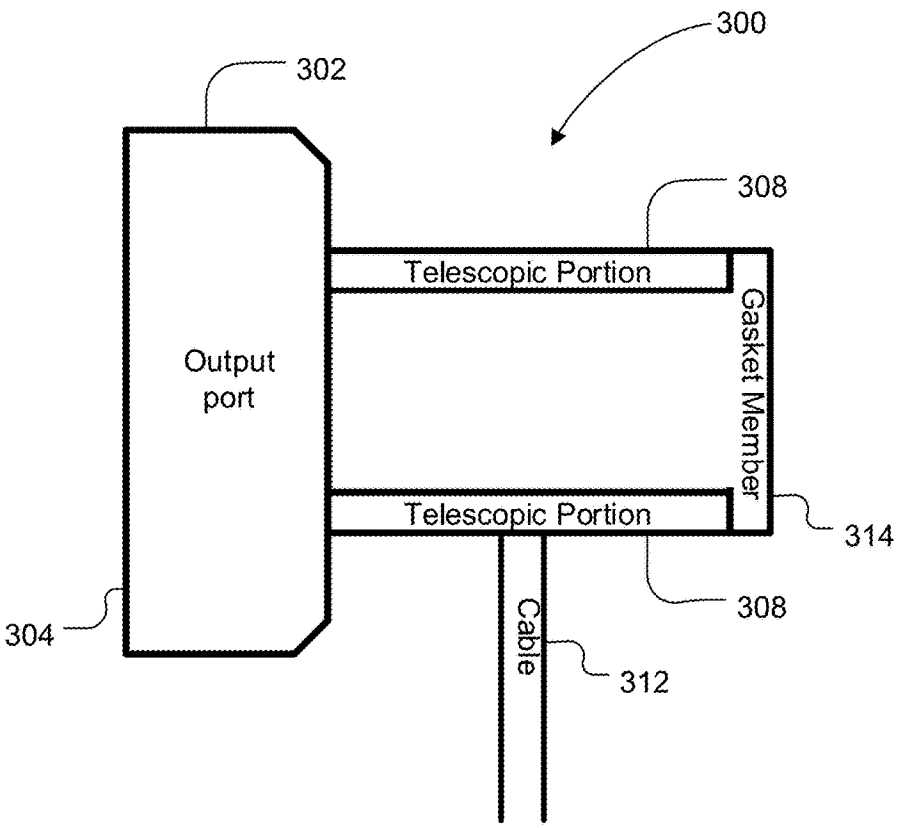
FIG. 3B is an example diagram of an earphone device in accordance with aspects of the present discloser.
Figure 3A:
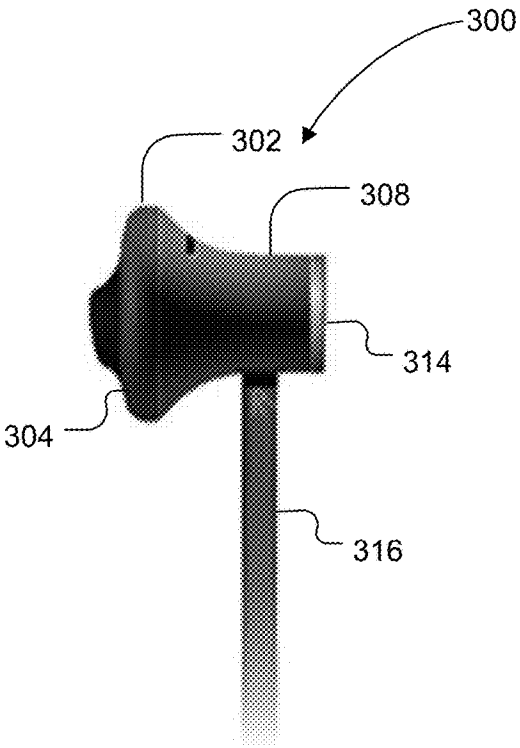
FIG. 3A is an example illustration of an earphone device in accordance with aspects of the present discloser.

FIGS. 3A-3B depicts views of an earphone device 300, for example, that includes a gasket member 314 in a closed position. The closed position of gasket member 314 may indicate, for example, as shown here, that the member is fully inserted into a telescopic portion 308 of housing 302. As shown in these examples, the earphone device 300 includes a housing that may include an output port 304 and a telescopic portion 308 having a hollow interior tube section. In some examples, the earphone device 300 may also include a gasket assembly for securing the gasket member 314 in the hollow interior tube section. The gasket assembly may allow gasket member 314 to pass through the telescopic portion 308, thus affecting a bass frequency range of sound resonating from the earphone device 300.

Sound output from the earphone device 300 may be based on a signal, such as an audio signal, which may be received via a connected wire or cable. For example, as shown in FIGS. 3A-3B, the earphone device 300 may include a cable 312 for receiving an audio signal. In this example, one end of the cable may be electrically connected to the housing 102 while the other end may be connected to an electronic device, such as a portable music player or cell phone, which may be used to transmit the audio signal. In some aspects, the audio signal may also be received wirelessly using Bluetooth™, WiFi or various other types of interfaces for transmitting and receiving wireless signals.

Figure 4B:
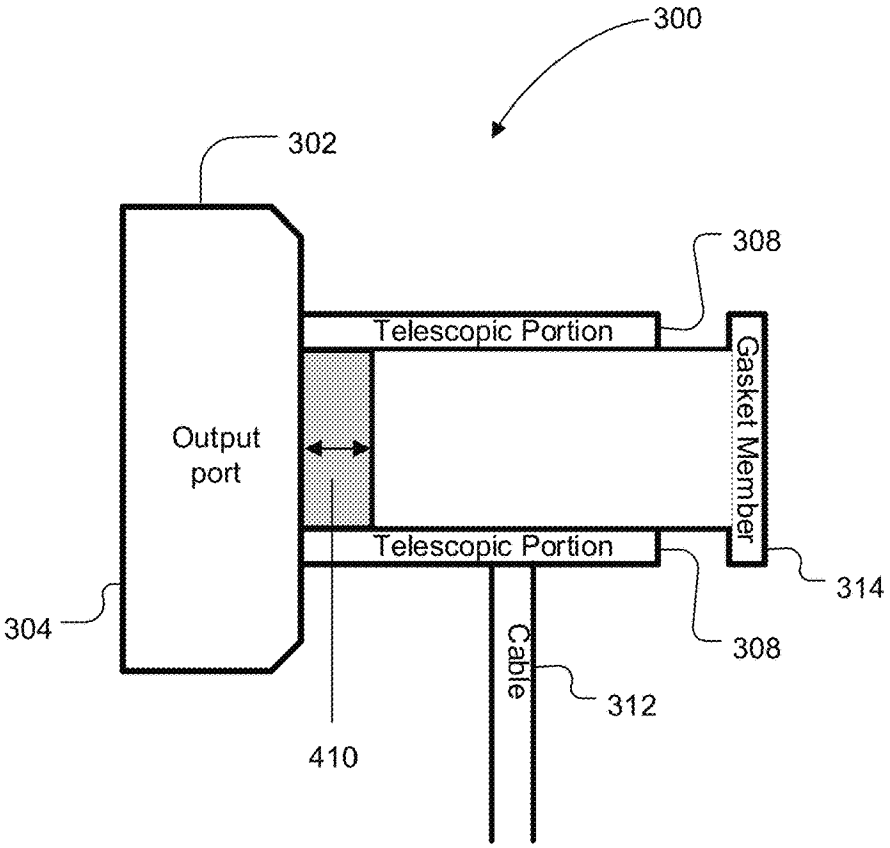
FIG. 4B is an example diagram of an earphone device in accordance with aspects of the present discloser.
Figure 4A:
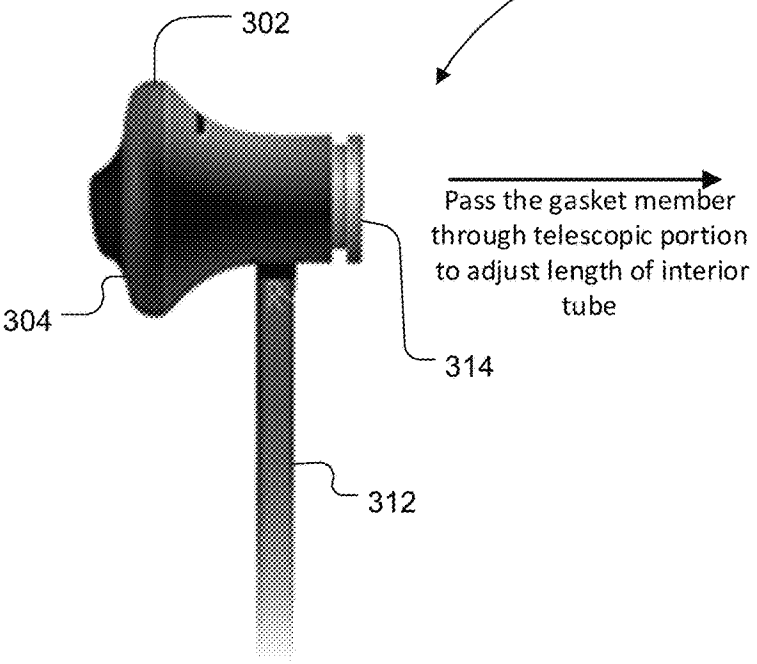
FIG. 4A is an example illustration of an earphone device in accordance with aspects of the present discloser.

FIGS. 4A-4B depicts views of the earphone device 300, for example, that includes a gasket member 314 in an open position. The open position of the gasket member 314 may indicate, for example, as shown here, that the member 314 may be partially inserted into a telescopic portion 308 of housing 302. As discussed above, this may affect how sound resonates from output port 304 of the earphone device 300. For example, as the gasket member 314 passes through the telescopic portion 308, length of an interior hollow tube portion 410 of the telescopic portion 308 may increase or decrease. Depending on the length of the hollow tube portion 410, sound may resonate from the earphone device 300 at a higher or lower bass range frequency. This correlation between the length of hollow tube portion and the bass range frequency of an earphone device is further discussed below with respect to FIG. 5.

Figure 5:
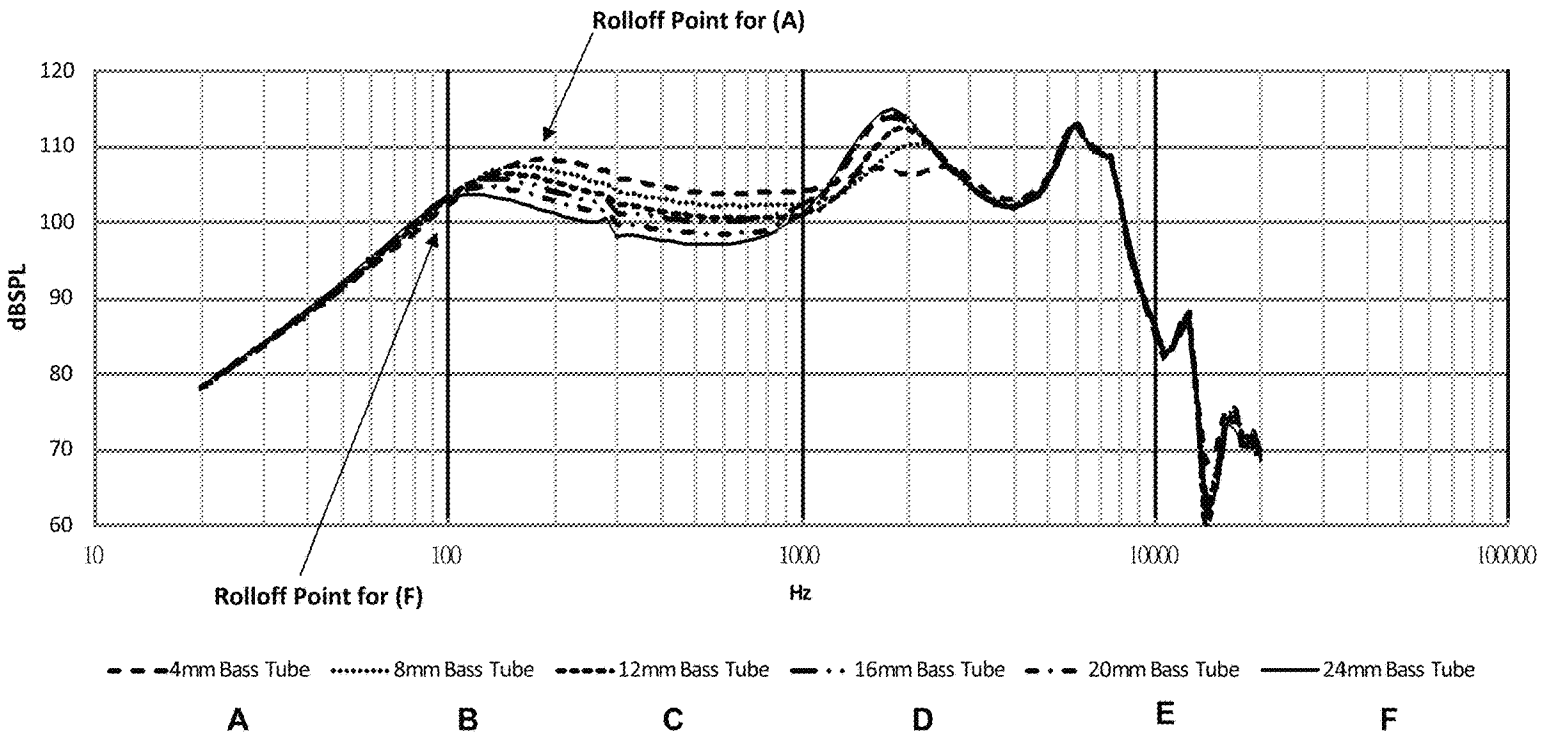
FIG. 5 is a graph of frequency characteristics for an earphone device in accordance with aspects of the present discloser.

FIG. 5 is a graph 500 of frequency characteristics for an earphone device, such as the earphone device 100 described with respect to FIG. 1, as the length of hollow tube portion of the device is adjusted. As shown in the graph, the empirical acoustic data plots (representing response curves) for tube lengths (A-F) demonstrate a direct correlation between an increasing tube length and the frequency response (e.g., deeper bass) of the earphone device. In general, a point at which each response curve (A-F) begins to slope down at low frequencies is called the 'rolloff point' of the frequency response. Typically, a user's perception of low bass frequencies will increase as this 'rolloff point' is located at a lower frequency.

By looking at graph 500, the frequency characteristics of two extremes case of a relatively short (4 mm) base tube (A) and a relatively long (24 mm) base tube (F) can be compared. As shown in FIG. 5, the rolloff point of the 4 mm bass tube (A) is about 200 Hz, while the rolloff point of the 24 mm bass tube (F) is about 100 Hz or basically one full octave lower in frequency. Based on this empirical data, it may appear as if the long bass tube is not actually producing more 'loudness' in the bass than the short tube, but rather just reducing the relative midrange. However, a human ear generally focuses on relative loudness levels (e.g., bass vs. midrange vs. highs), thus the relative amount of perceived low bass is still greater with the longer bass tube.

Based on this empirical data, it can be shown that some additional acoustic adjustments are perceived in the upper frequencies, for example, up to about 3000 Hz. This may affect the overall tonality of an earphone device of the present disclosure in various bass tube configurations, but can also contribute an end-user's preference of their 'own' preferred sound. On the other hand, the bass tube length has virtually no effect above 3000 Hz. For example, as shown on the graph 500, as the frequency raises above 3000 Hz the acoustic data plots for tube lengths (A-F) become less distinct. In some aspects, the earphone device may be configured so that this frequency range may change slightly, but in general the bass tube length may not affect high frequencies.

Figure 6:
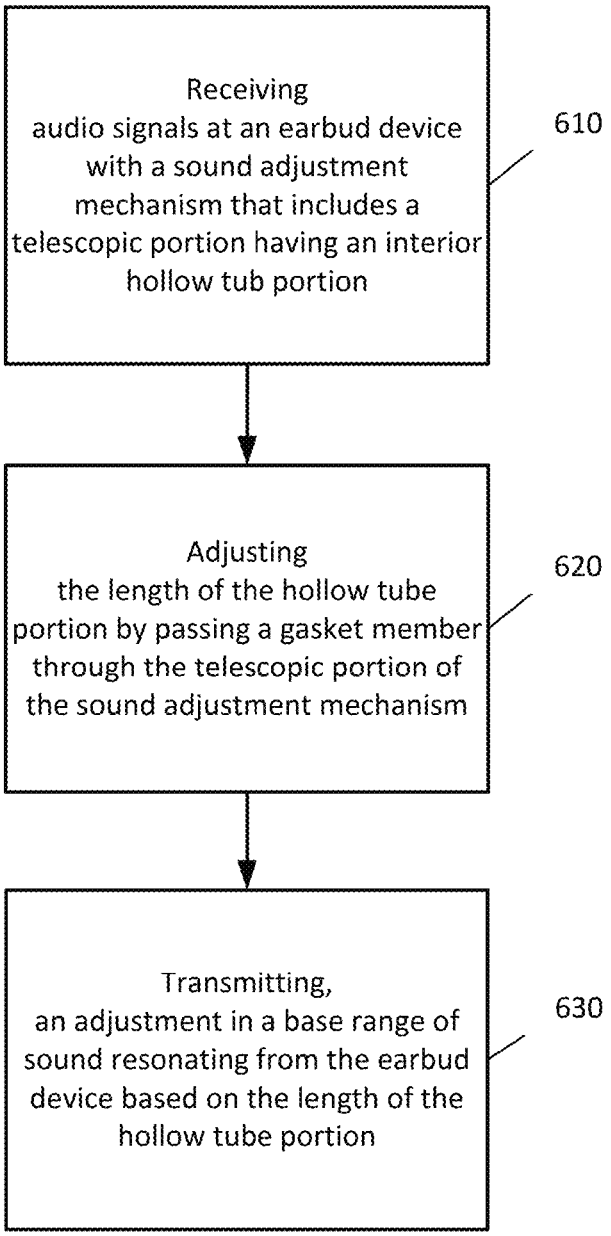
FIG. 6 is an example of a method in accordance with aspects of the present discloser.

FIG. 6 is an example of a method that may be used to dynamically adjust sound acoustics resonating from an earphone device, such the earphone device 100 described with respect to FIG. 1.

At step 610, audio signals may be received at an earphone device with sound adjustment capability. For example, the earphone device may include a housing having an acoustic output port where sound resonates from based on the received audio signals, and a sound adjustment mechanism that includes a telescopic portion having a hollow tube portion attached to the housing. According to aspects of the disclosure, an end user using the device can control how sound resonates from the output port by dynamically adjusting a length of the interior hollow tube portion. For example, depending on the length of the interior hollow tube portion, sound may resonate at a certain high or low frequency from the earphone device.

At step 620, the length of the interior hollow tube portion may be adjusted. For example, in response to user input, the length of the interior hollow tube portion may be adjusted by passing a gasket member through the telescopic portion of the sound adjustment mechanism. In some aspects, the telescopic portion of the earphone device may be adapted to receive the gasket member. For example, the sound adjustment mechanism may include a gasket assembly that may secure the gasket member in the hollow tube portion. This may allow the gasket member to safely pass inwardly and outwardly through the telescopic portion. In turn, the gasket member can be either partially or fully disposed within the telescopic portion of the sound adjustment mechanism.

In some situations, the telescopic portion of the earphone device may be adapted to receive a threaded gasket member. For example, the hollow tube portion may include internal threads that are capable of accepting the threaded gasket member. In this example, the threaded gasket member can safely pass inwardly and outwardly through the telescopic portion by turning it 360 degrees in one direction or another. In this regard, the threaded gasket member can also be either partially or fully threadably disposed within the telescopic portion of the sound adjustment mechanism.

At step 630, an adjustment in a base range of sound resonating from the earphone device may be transmitted based on a length of the hollow tube portion. For example, depending on the length of the hollow tube portion, sound may resonate from the earphone device at a higher or lower bass range frequency.

As these and other variations and combinations of the features discussed above can be utilized without departing from the disclosure as defined by the claims, the foregoing description of the embodiments should be taken by way of illustration rather than by way of limitation of the disclosure as defined by the claims. It will also be understood that the provision of examples of the disclosure (as well as clauses phrased as "such as," "e.g.", "including" and the like) should not be interpreted as limiting the disclosure to the specific examples; rather, the examples are intended to illustrate only some of many possible embodiments.

The invention claimed is:

1. An earphone device with sound adjustment capability, comprising:

a housing having a hollow portion, the housing having first end and a second end;

an acoustic output port at the first end being adapted to receive audio signals, wherein sound resonates from the acoustic output port according to the audio signals; and a fitting member securely inserted within the housing through the second end, the fitting member being configured to adjust the sound when the fitting member is arranged between a closed position within the housing and an open position within the housing, the closed position being the fitting member fully inserted within the housing and the open position being the fitting member partially inserted within the housing, wherein the acoustic output port is confined within the housing, and wherein a length of the hollow portion is shorter when the fitting member is in the closed position than when the fitting member is in the open position.

2. The earphone device of claim 1, further comprising a cover fitting around the first end of the housing, wherein the cover is configured to conform to contours of a user's ear.

3. The earphone device of claim 1, wherein a movement of the fitting member from the closed position to the open position decreases a bass range of the sound resonating from the acoustic output port.

4. The earphone device of claim 1, wherein a movement of the fitting member from the open position to the closed position increases a bass range of the sound resonating from the acoustic output port.

5. The earphone device of claim 1, wherein the hollow portion includes internal threads configured to accept the fitting member, and the fitting member includes threads configured to couple with the internal threads of the hollow portion.

6. The earphone device of claim 5, wherein rotation of the fitting member in a first direction increases the length of the hollow portion and rotation of the fitting member in a second direction opposite the first direction decreases the length of the hollow portion.

7. The earphone device of claim 1, further comprising a cable electrically connected to the housing for receiving the audio signals from an electronic device.

8. An apparatus with sound adjustment capability, comprising:

a housing having a hollow portion, the housing having first end and a second end;

an interface configured to receive audio signals;

an acoustic output port at the first end from which sound resonates according to the audio signals; and a fitting member securely inserted within the housing through the second end, the fitting member being configured to adjust the sound when the fitting member is arranged between a closed position within the housing and an open position within the housing, the closed position being the fitting member fully inserted within the housing and the open position being the fitting member partially inserted within the housing, wherein the acoustic output port is confined within the housing, and wherein a length of the hollow portion is shorter when the fitting member is in the closed position than when the fitting member is in the open position.

9. The apparatus of claim 8, further comprising a cover fitting around the first end of the housing, wherein the cover is configured to conform to contours of a user's ear.

10. The apparatus of claim 8, wherein a movement of the fitting member from the closed position to the open position decreases a bass range of the sound resonating from the acoustic output port.

11. The apparatus of claim 8, wherein a movement of the fitting member from the open position to the closed position increases a bass range of the sound resonating from the acoustic output port.

12. The apparatus of claim 8, wherein the hollow portion includes internal threads configured to accept the fitting member, and the fitting member includes threads configured to couple with the internal threads of the hollow portion.

13. The apparatus of claim 12, wherein rotation of the fitting member in a first direction increases the length of the hollow portion and rotation of the fitting member in a second direction opposite the first direction decreases the length of the hollow portion.

14. The apparatus of claim 8, wherein the interface is configured to wirelessly receive the audio signals from an electronic device.

15. A method, comprising:

receiving audio signals at an earphone device with sound adjustment capability, the earphone device comprising:

a housing having a hollow portion, the housing having first end and a second end;

an acoustic output port at the first end being adapted to receive audio signals, wherein sound resonates from the acoustic output port according to the audio signals; and a fitting member securely inserted within the housing through the second end, the fitting member being configured to adjust the sound when the fitting member is arranged between a closed position within the housing and an open position within the housing, the closed position being the fitting member fully inserted within the housing and the open position being the fitting member partially inserted within the housing, wherein the acoustic output port is confined within the housing, and wherein a length of the hollow portion is shorter when the fitting member is in the closed position than when the fitting member is in the open position;

in response to input, adjusting the length of the hollow portion by passing the fitting member through the housing; and transmitting an adjustment in a bass range of the sound resonating from the acoustic output port in accordance with the length of the hollow portion.

16. The method of claim 15, wherein a movement of the fitting member from the closed position to the open position decreases the bass range of the sound resonating from the acoustic output port.

17. The method of claim 15, wherein a movement of the fitting member from the open position to the closed position increases the bass range of the sound resonating from the acoustic output port.

18. The method of claim 15, wherein adjusting the length of the hollow portion includes rotating the fitting member in a first direction to increase the length of the hollow portion or rotating the fitting member in a second direction opposite the first direction to decrease the length of the hollow portion.

19. The method of claim 15, wherein adjusting the length of the hollow portion selects a resonance frequency.

20. The method of claim 15, wherein adjusting the length of the hollow portion filters a range of frequencies.

* * * * *